US008021025B2

(12) United States Patent
Lee

(10) Patent No.: US 8,021,025 B2
(45) Date of Patent: Sep. 20, 2011

(54) LED LAMP

(75) Inventor: Ke-Chin Lee, Taipei (TW)

(73) Assignee: Yeh-Chiang Technology Corp., Yangmei Chen, Taoyuan Hsien (TW)

( * ) Notice: Subject to any disclaimer, the term of this patent is extended or adjusted under 35 U.S.C. 154(b) by 336 days.

(21) Appl. No.: 12/354,622

(22) Filed: Jan. 15, 2009

(65) Prior Publication Data

US 2010/0177522 A1 Jul. 15, 2010

(51) Int. Cl.
*F21V 29/00* (2006.01)

(52) U.S. Cl. ..... 362/373; 362/294; 362/363

(58) Field of Classification Search ..... 362/373, 362/294, 800, 363
See application file for complete search history.

(56) References Cited

U.S. PATENT DOCUMENTS

| | | | | |
|---|---|---|---|---|
| 7,674,015 | B2 * | 3/2010 | Chien | 362/294 |
| 2006/0001384 | A1 * | 1/2006 | Tain et al. | 315/246 |
| 2006/0193139 | A1 * | 8/2006 | Sun et al. | 362/373 |
| 2007/0230172 | A1 * | 10/2007 | Wang | 362/249 |
| 2008/0013316 | A1 * | 1/2008 | Chiang | 362/264 |
| 2008/0055909 | A1 * | 3/2008 | Li | 362/294 |
| 2009/0135594 | A1 * | 5/2009 | Yu et al. | 362/234 |
| 2011/0001417 | A1 * | 1/2011 | Stekelenburg | 313/46 |

* cited by examiner

*Primary Examiner* — James Lee
*Assistant Examiner* — Mark Tsidulko
(74) *Attorney, Agent, or Firm* — patenttm.us

(57) ABSTRACT

An LED lamp has a base, a tubular conductor, a bulb and at least one LED. The base is metallic and has an electrical connector. The tubular conductor is filled with a fluid and mounted on the base and has a distal end and a proximal end. The bulb is pellucid and connected to the base. The at least one LED is mounted on the distal end of the tubular conductor and electrically connected to the connector of the base. The fluid in the tubular conductor may vaporize close to operating temperatures of the LED so transports heat away from the LED quickly and efficiently so allowing high power or multiple LEDs to be implemented, so improving brightness of the LED lamp and commercial applications.

5 Claims, 14 Drawing Sheets

LED LAMP

BACKGROUND OF THE INVENTION

1. Field of the Invention

The present invention relates to a light-emitting diode (LED) lamp with improved brightness.

2. Description of the Prior Art

With reference to FIGS. 13 and 14, a conventional LED lamp comprises a base (96), a metal rod (91), at least one LED (92), a bulb (95) and a base (96). The base (96) has a plug, an inner surface, and multiple fins (93). The multiple fins (93) correspond to and are parallelly stacked on the inner surface of the base (96). The metal rod (91) has a distal end, a proximal end and an outer surface. The proximal end of the metal rod (91) is mounted through the fins (93) and attached to the base (96). The at least one LED (92) is attached to the distal end of the metal rod (91) and is connected to the plug of the base (96). The bulb (95) is mounted securely on the base (96) and covers the metal rod (91), LED (92), and fins (93).

When supplied with a power from a power source, the conventional LED lamp illuminates and generates heat that is transported away by the metal rod (91) to prevent overheating and damage to the LED (92) or LED lamp. However, the metal rod (91) has a limited conduction capacity so limiting a number of LEDs (92) and preventing high-power LEDs from being implemented, thereby limiting maximum brightness of the LED lamp.

To overcome the shortcomings, the present invention provides an LED lamp to mitigate or obviate the aforementioned problems.

SUMMARY OF THE INVENTION

The main objective of the invention is to provide an LED lamp.

The LED lamp in accordance with the present invention has a base, a tubular conductor, a bulb and at least one LED. The base is metallic and has an electrical connector. The tubular conductor is filled with a fluid and mounted on the base and has a distal end and a proximal end. The bulb is pellucid and connected to the base. The at least one LED is mounted on the distal end of the tubular conductor and electrically connected to the connector of the base. The fluid in the tubular conductor may vaporize close to operating temperatures of the LED so transports heat away from the LED quickly and efficiently so allowing high power or multiple LEDs to be implemented, so improving brightness of the LED lamp and commercial applications.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
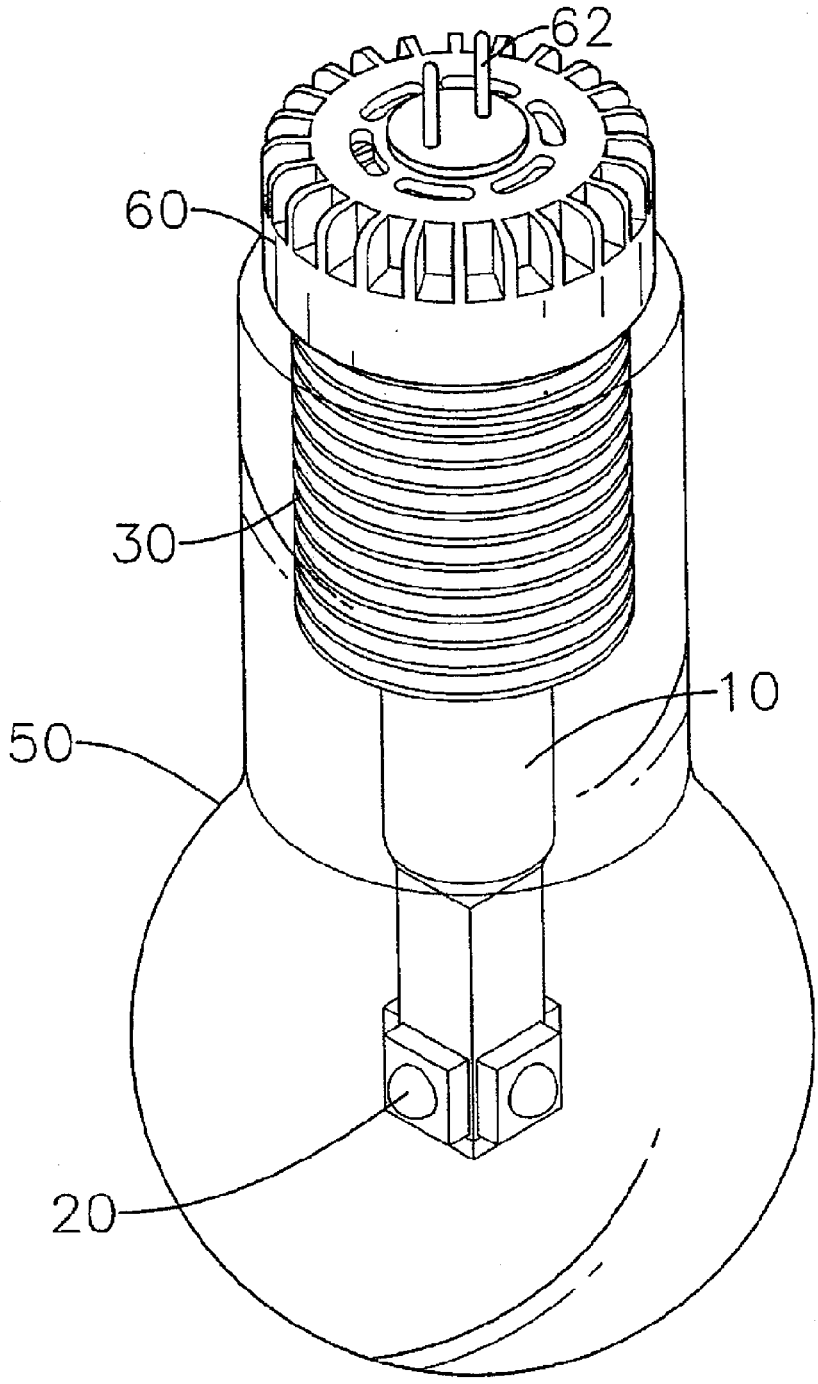
FIG. 1 is a perspective view of a first embodiment of an LED lamp in accordance with the present invention.
Figure 2:
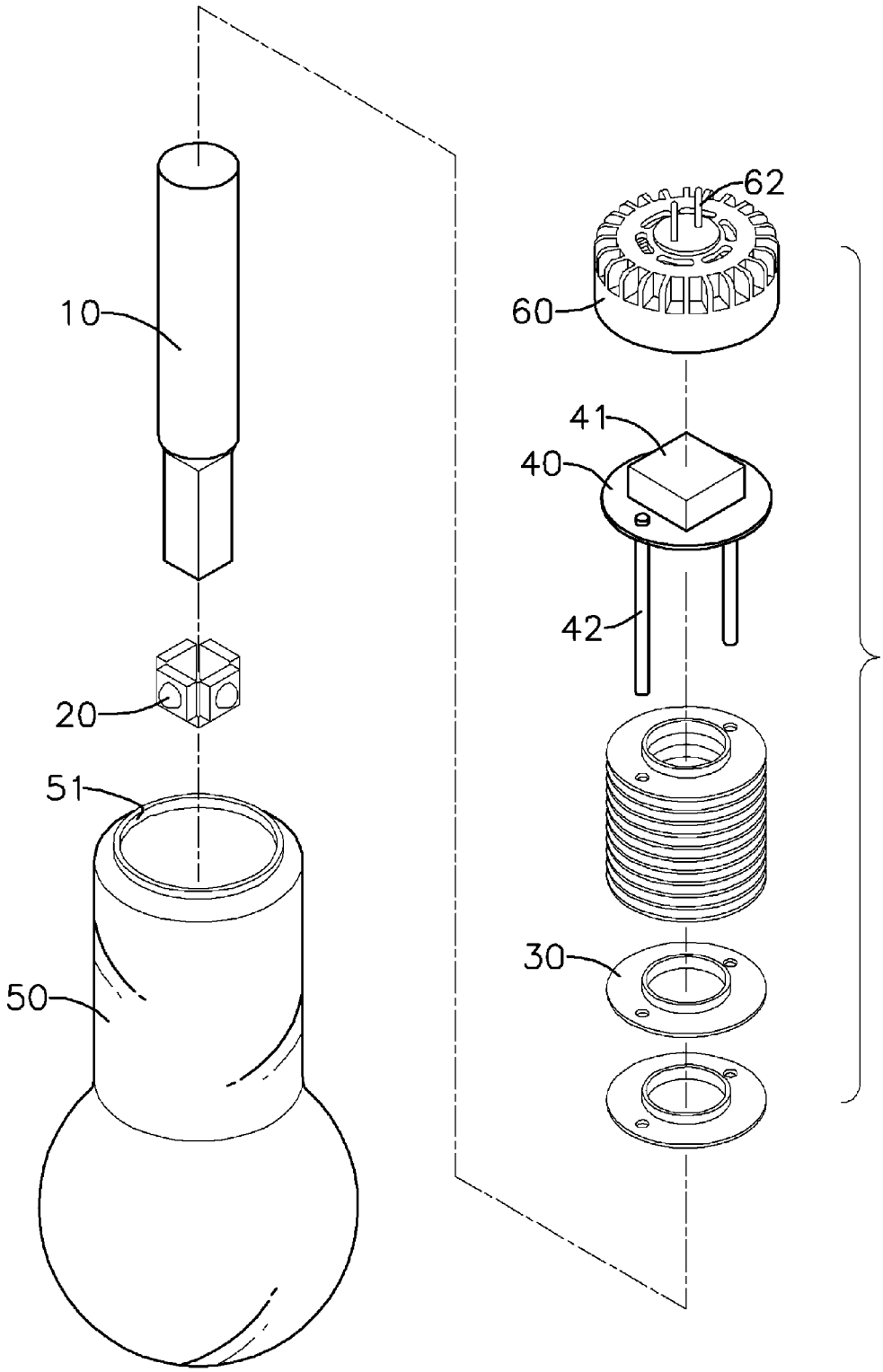
FIG. 2 is an exploded perspective view of the LED lamp in FIG. 1.
Figure 3:
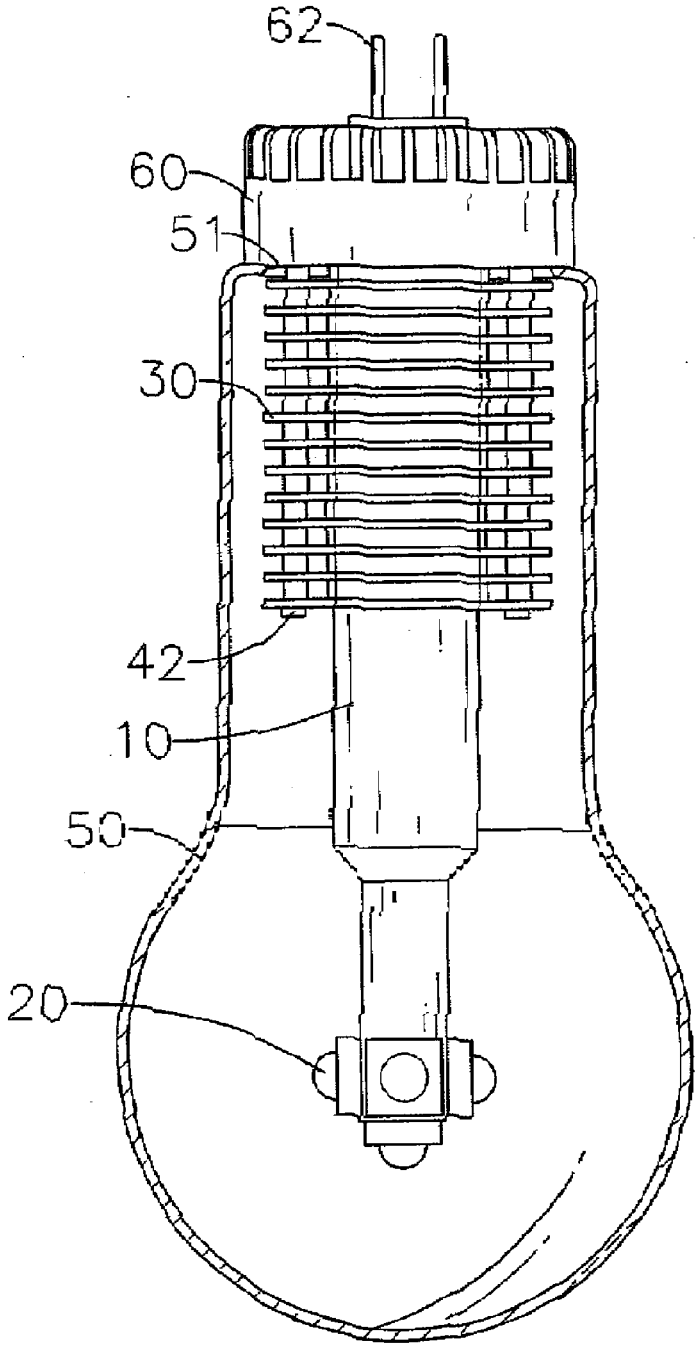
FIG. 3 is a side view of the LED lamp in FIG. 1 in partial section.

With reference to FIGS. 1, 2, 4, 5, 6 and 10, an LED lamp in accordance with the present invention comprises a base (60, 60A, 60C, 60D), a tubular conductor (10, 10B, 10C, 10D), at least one LED (20), a bulb (50, 50B, 50C), an optional ring (70), optional multiple fins (30) and an optional supporter (40).

With further reference to FIGS. 1 to 4, in a first embodiment or a second embodiment, the base (60, 60A) is metallic and comprises an electrical connector (62, 62A) and an optional controller (41) being a printed circuit board (PCB). The electrical connector (62) may comprise two contact pins disposed in accordance with industrial standards or the connector (62A) may comprise a tip contact and a screw thread contact in accordance with industrial standards. The industrial standards of the connector (62, 62A) may correspond to an E27 socket, an MR16 socket or the like. The connector (62, 62A) allows convenient installation of the LED lamp in a corresponding socket providing power from a power source. The controller (41), being the PCB, is mounted in the base (60), is connected to the electrical connector (62) and may comprise a rectifier, transformer, switch, timer and the like.

Figure 7:
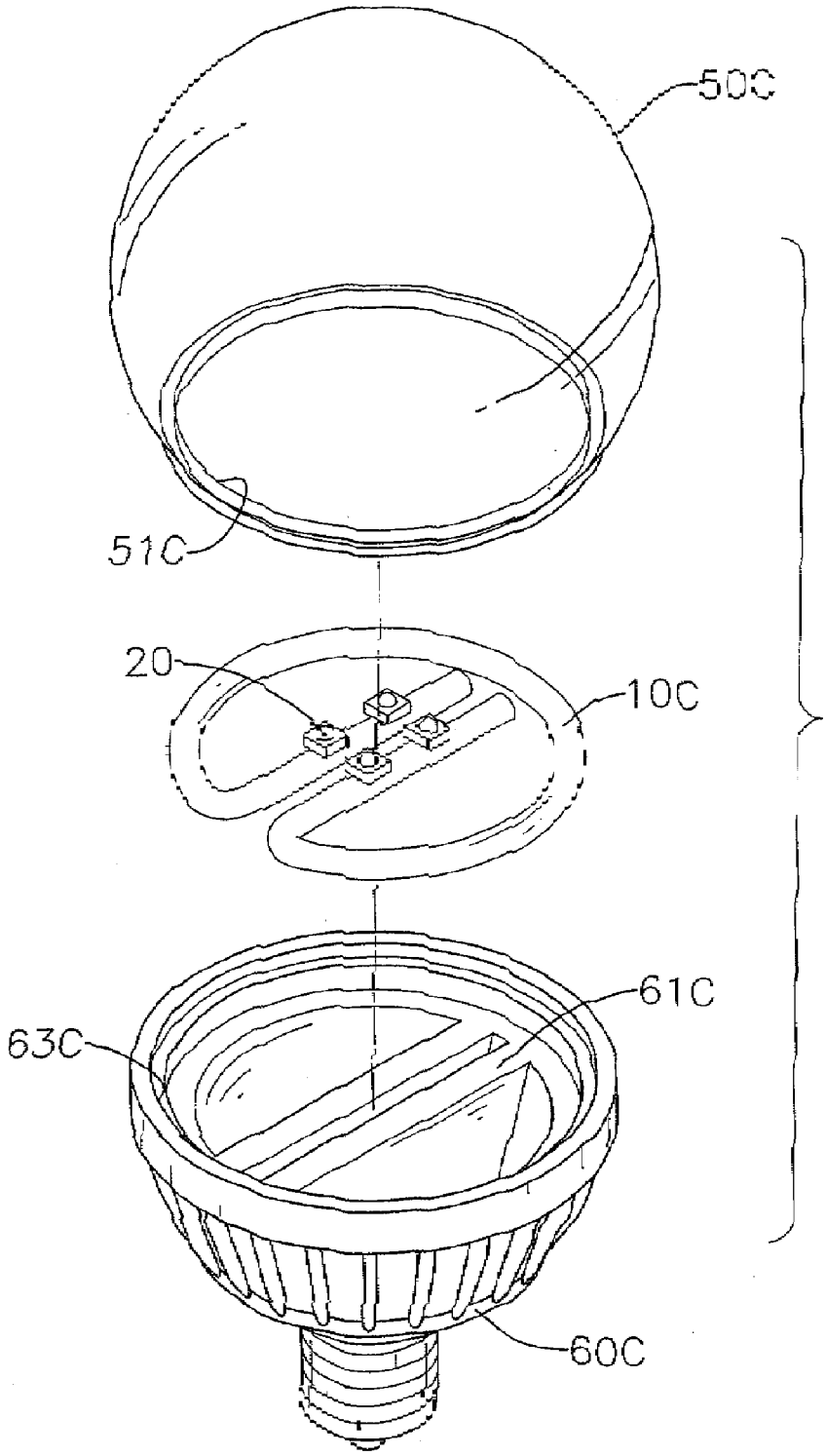
FIG. 7 is an exploded perspective view of the LED lamp in FIG. 6.
Figure 8:
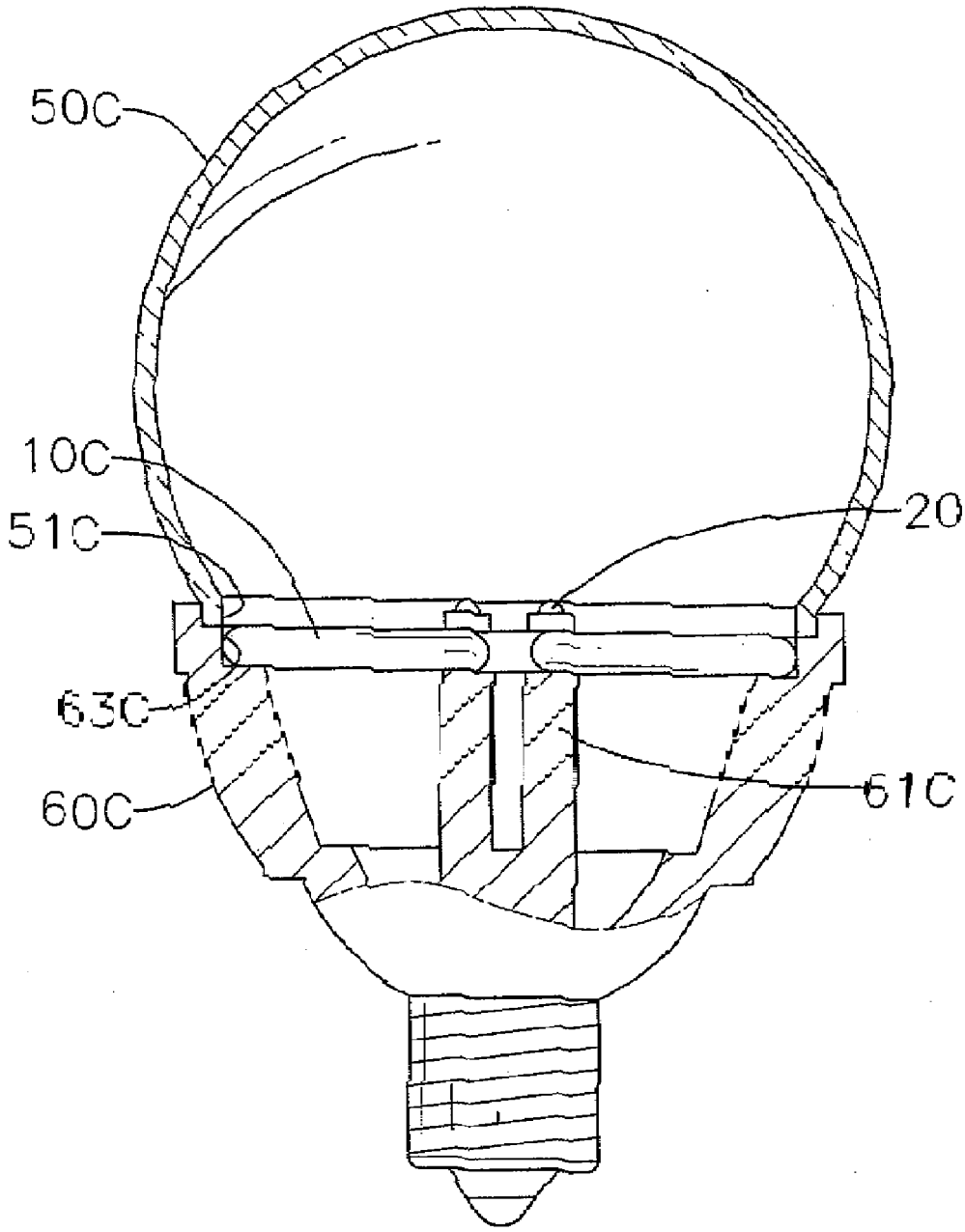
FIG. 8 is a side view of the LED lamp in FIG. 6 in partial section.
Figure 9:
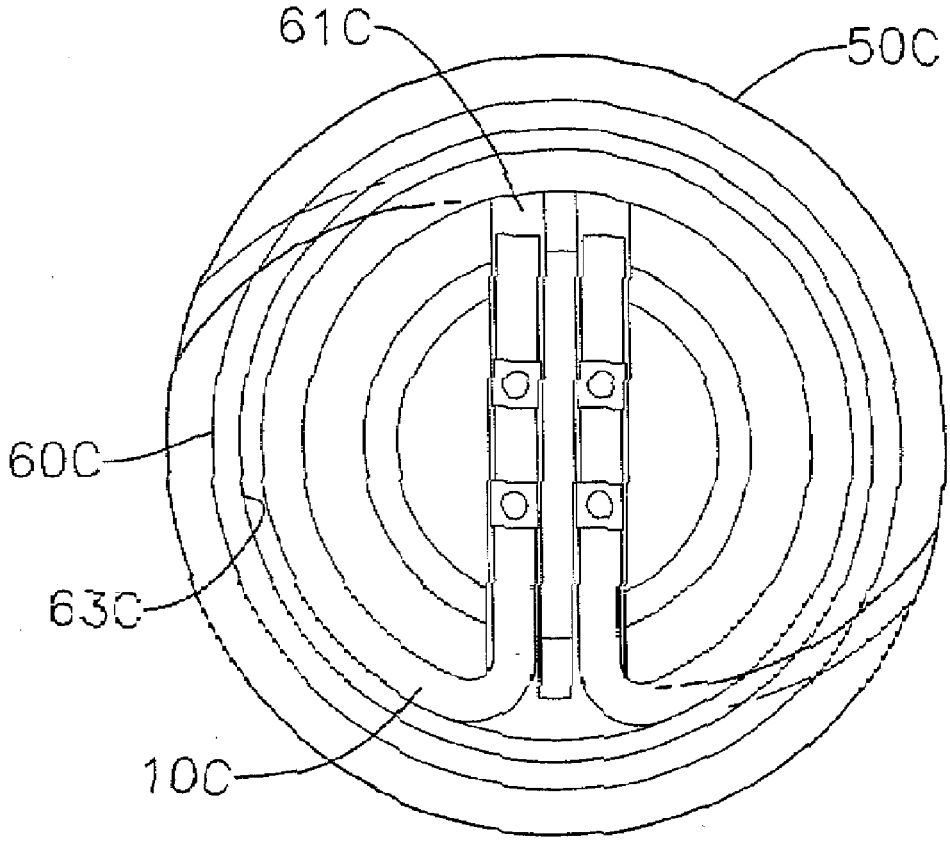
FIG. 9 is a top view of the LED lamp in FIG. 6.

With further reference to FIGS. 3, 4, 5, 6 and 10, in a first, second, third, four or fifth embodiment, the base (60, 60A, 60C, 60D) may be disk shaped, columnar or bowl shaped and may have a mouth (63C, 63D) and at least one bridge (61C, 61D). The mouth (63C, 63D) has an inner edge. The at least one bridge (61C, 61D) has two ends being formed on the inner edge of the mouth (63C, 63D) of the base (60C, 60D). When the base (60C, 60D) is bowl shaped, the base (60C, 60D) has an inner surface and a bottom. The bridge (61C, 61D) is formed on the inner surface and the bottom of the base (60C). With further reference to FIG. 7, the base (60C) may have multiple bridges (61C) formed parallelly.

With reference to FIGS. 1, 5, 6 and 10, the tubular conductor (10, 10B, 10C, 10D) has a casing, may be a sealed metal tube and has a proximal end, a distal end, an inner wall, an outer surface, an optional wick and a fluid. The wick is a narrow bore tube attached to the inner wall of the casing. The fluid may be a coolant selected to vaporize close to the operating temperature of LEDs. The proximal end is mounted on the base to allow cooling may be by welding or adhering with thermal grease. The distal end may be polygonal and have multiple flat portions. When the distal end is heated, the fluid vaporizes to a gas and quickly transfers heat to the proximal end for cooling, where the gas condenses before returning to distal end, maybe due to gravity, capillary action through the wick or the like. With further reference to FIGS. 6 to 9, two tubular conductors (10C) may be formed together at the proximal ends and mounted on the base (50C).

Figure 5:
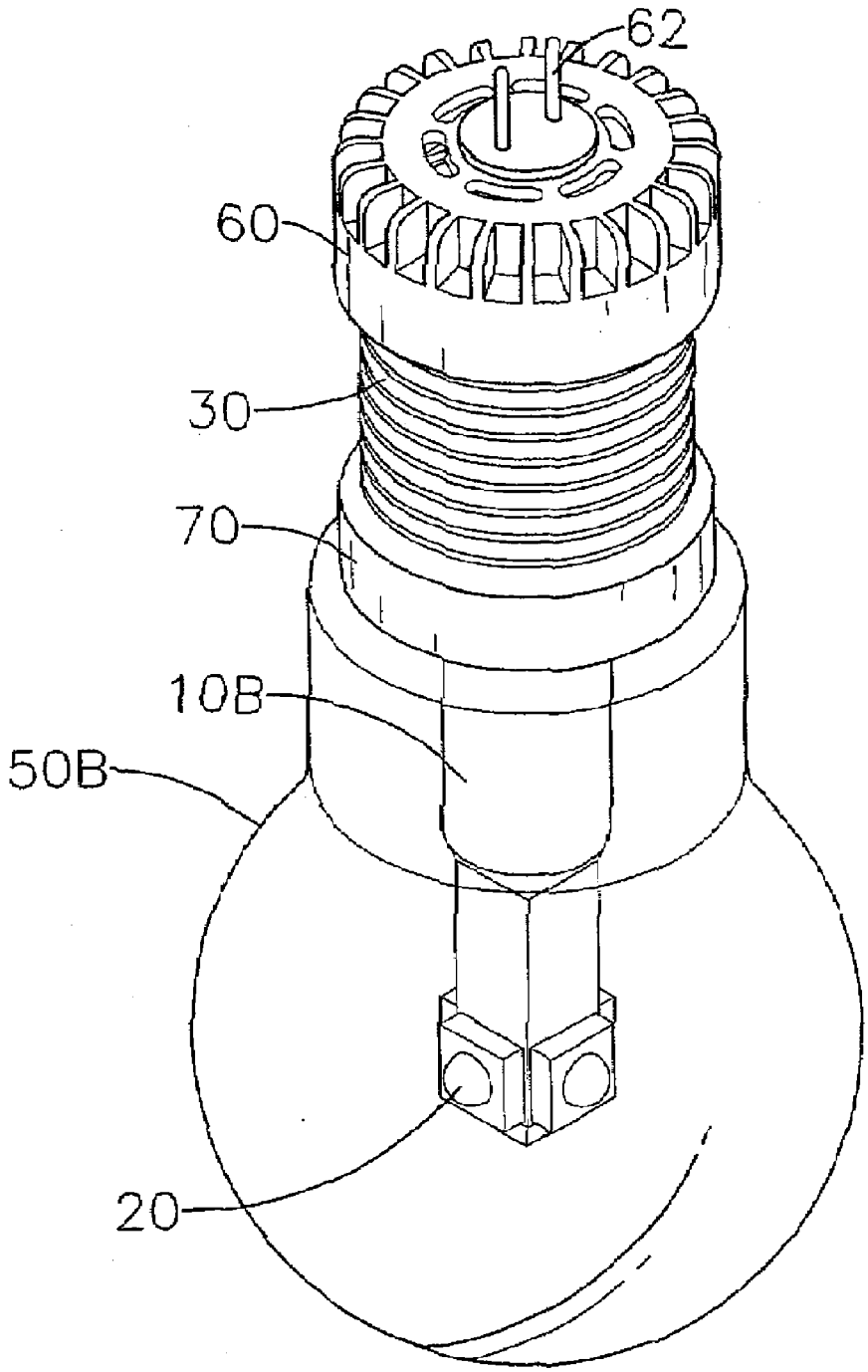
FIG. 5 is a perspective view of a third embodiment an LED lamp in accordance with the present invention further having a ring sealing a bulb.
Figure 6:
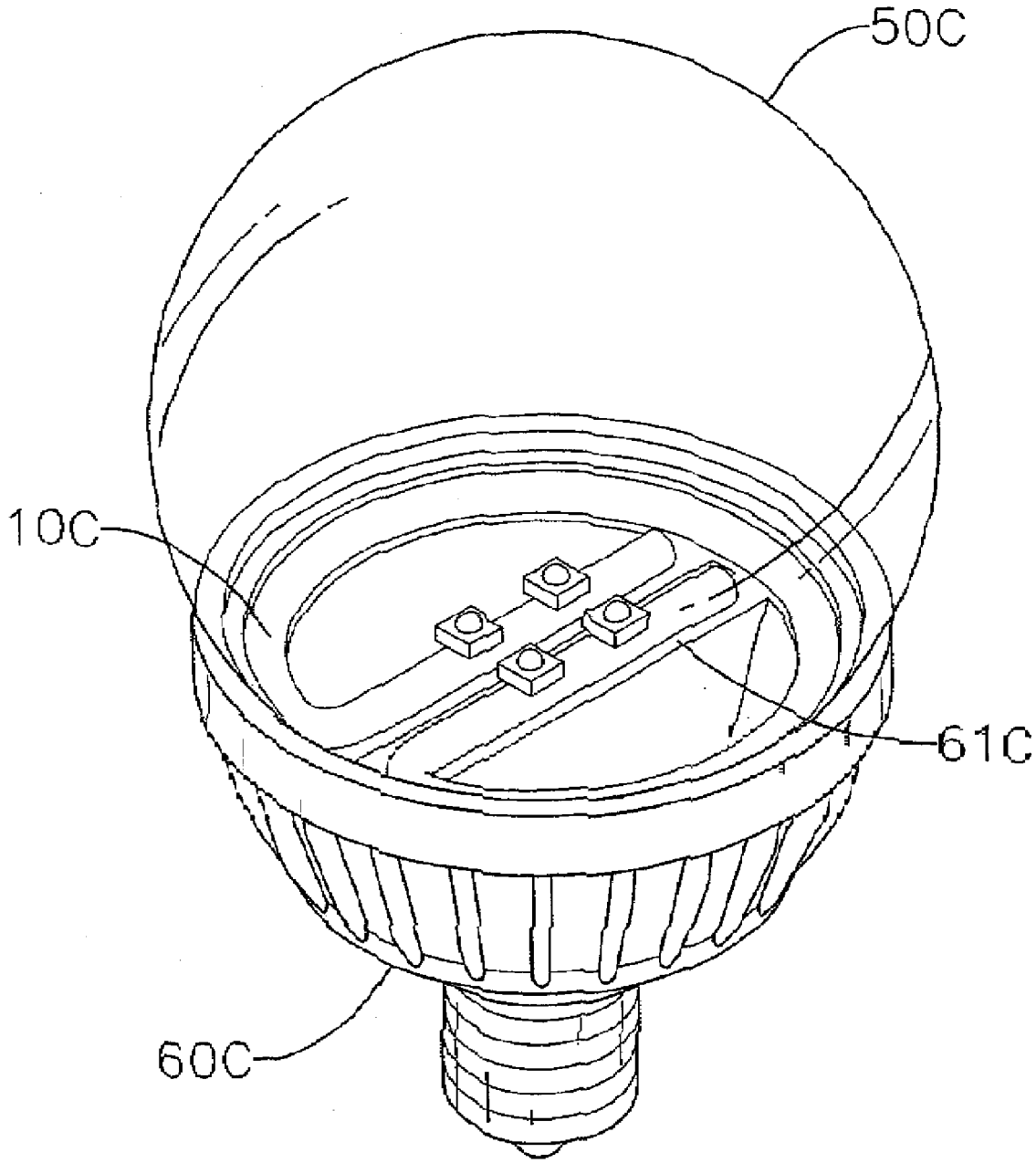
FIG. 6 is a perspective view of a fourth embodiment of an LED lamp in accordance with the present invention.

With reference to FIG. 5, in the third embodiment of the present invention, the optional ring (70) is mounted on the outer surface of the tubular conductor (10) at the proximal end, seals the opening (51C) of the bulb (50B) and may stabilize the bulb (50B).

Figure 4:
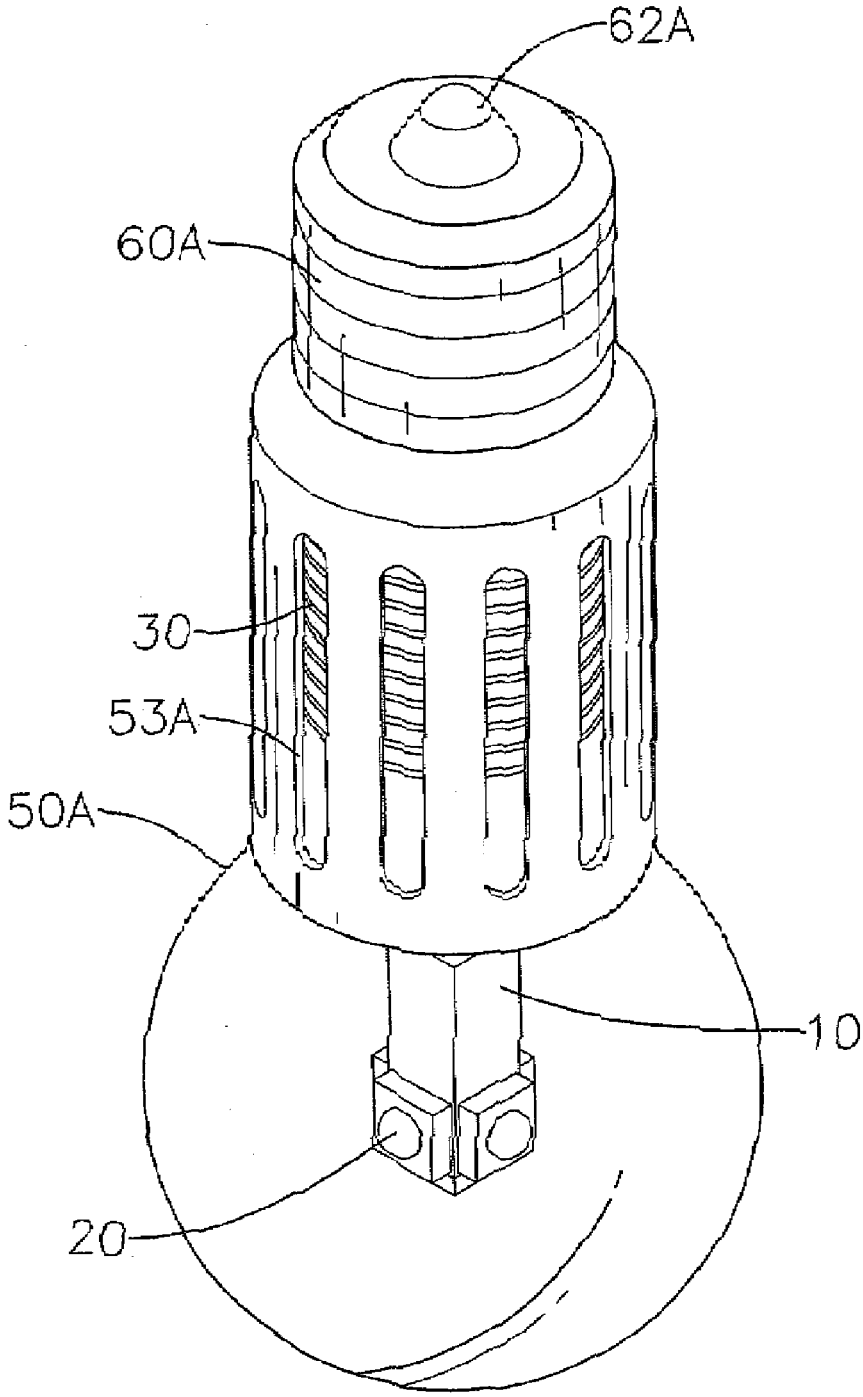
FIG. 4 is a perspective view of a second embodiment of an LED lamp in accordance with the present invention with a bulb having windows.

With reference to FIGS. 1 to 4, in the first or second embodiment, the bulb (50) is pellucid, may be colored and is connected to the base (60, 60A) and may be mounted securely in the base (60C) or may be mounted securely on the tubular conductor (10) exposing the proximal end of the tubular conductor (10B) directly to an external environment. With reference to FIG. 5, the bulb (50B) may be mounted securely on and sealed closed by the ring (70). With further reference to FIG. 4, in the second embodiment, the bulb (50A) has a bowl, an opening and may have a neck and multiple windows (53A). The opening communicates with the bowl and is connected to the base (60A), may be mounted securely on the base (60A). The neck is formed on and protrudes from the bowl. The windows (53A) are formed through the neck near the opening for improved ventilation.

With reference to FIGS. 1 to 5, the at least one LED (20) is attached to the tubular conductor (10, 10B) and electrically connected to the connector (62, 62A) of the base (60, 60A), may be attached to one flat portion of the distal end of the tubular conductor (10, 10B) and may be connected to the controller (40).

When the LED (20) receives power and generates light, the LED (20) also generates heat. Heat generated by the LED (20) is effectively transported by the tubular conductor (10) to prevent or to reduce unnecessary heating of the LED (20). Thus the LED (20) will operate normally without being overheated allowing more LEDs or more powerful LEDs to be implemented for improved brightness and commercial applicability.

With further reference to FIGS. 6 to 12, when the base (60C, 60D) is implemented with the bridge (61C, 61D), the tubular conductor (10C, 10D) contacts the inner edge of the mouth (63C, 63D) of the base (60C, 60D) and the bridge (61C, 61D). The tubular conductor (10C, 10D) may be welded or stuck to the inner edge of the base (60C, 60D) and the bridge (61C, 61D). The tubular conductor (10C, 10D) transports heat from the LED (20) to the base (60C, 60D). The heat is dispersed within the base (60C, 60D), which is metallic so transfers heat to the environment from the base (60C, 60D). The bridge (61C, 61D) not only increases area of thermal contact between the base (60C, 60D) and the tubular conductor (10C, 10D), but also structurally supports the tubular conductor (10C, 10D).

With further reference to FIGS. 6 to 9, in the fourth embodiment, the outer surface of the tubular conductor (10C) near the proximal end and the outer surface of the tubular conductor (10C) near the distal end may contact the bridge (61C) of the base (60C).

Figure 10:
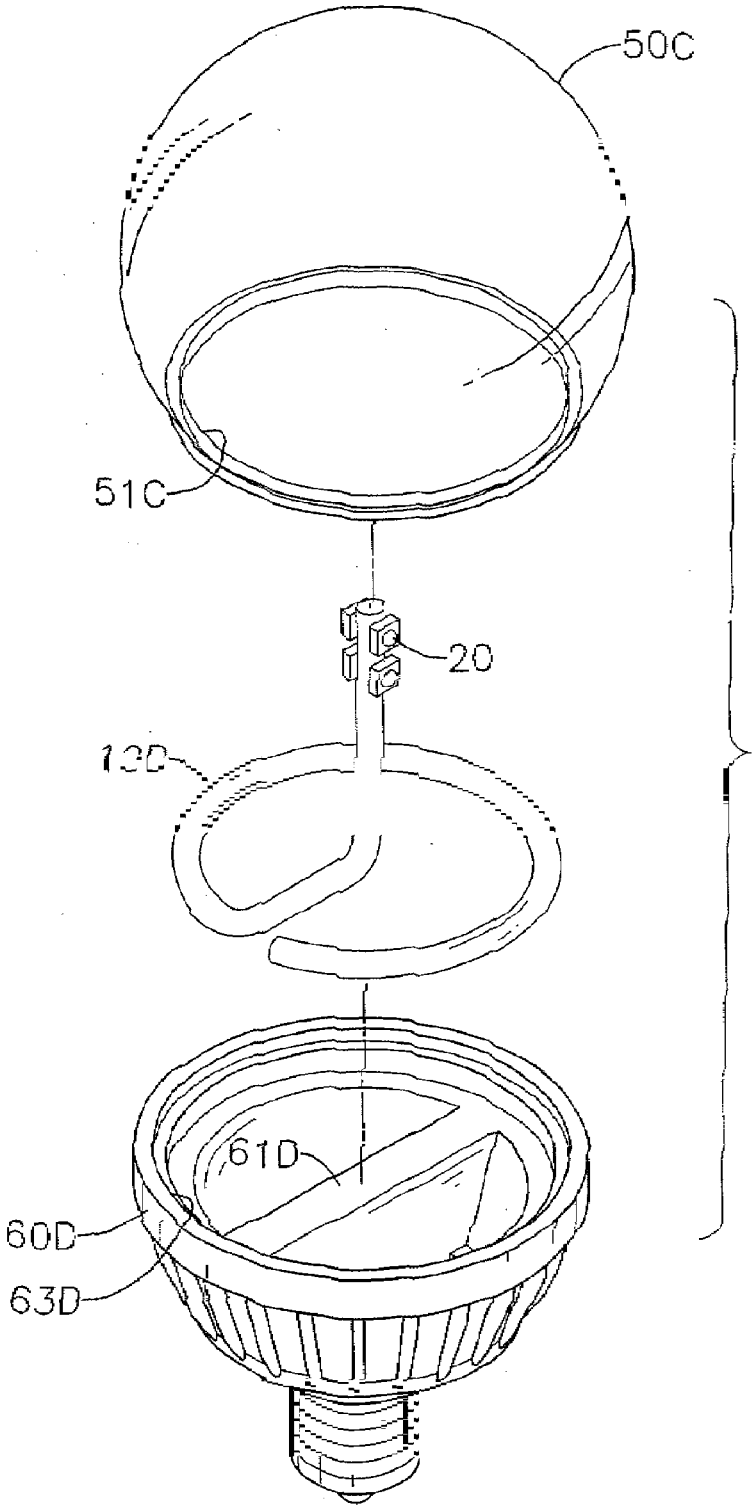
FIG. 10 is a perspective view of a fifth embodiment of the LED lamp in accordance with the present invention.
Figure 11:
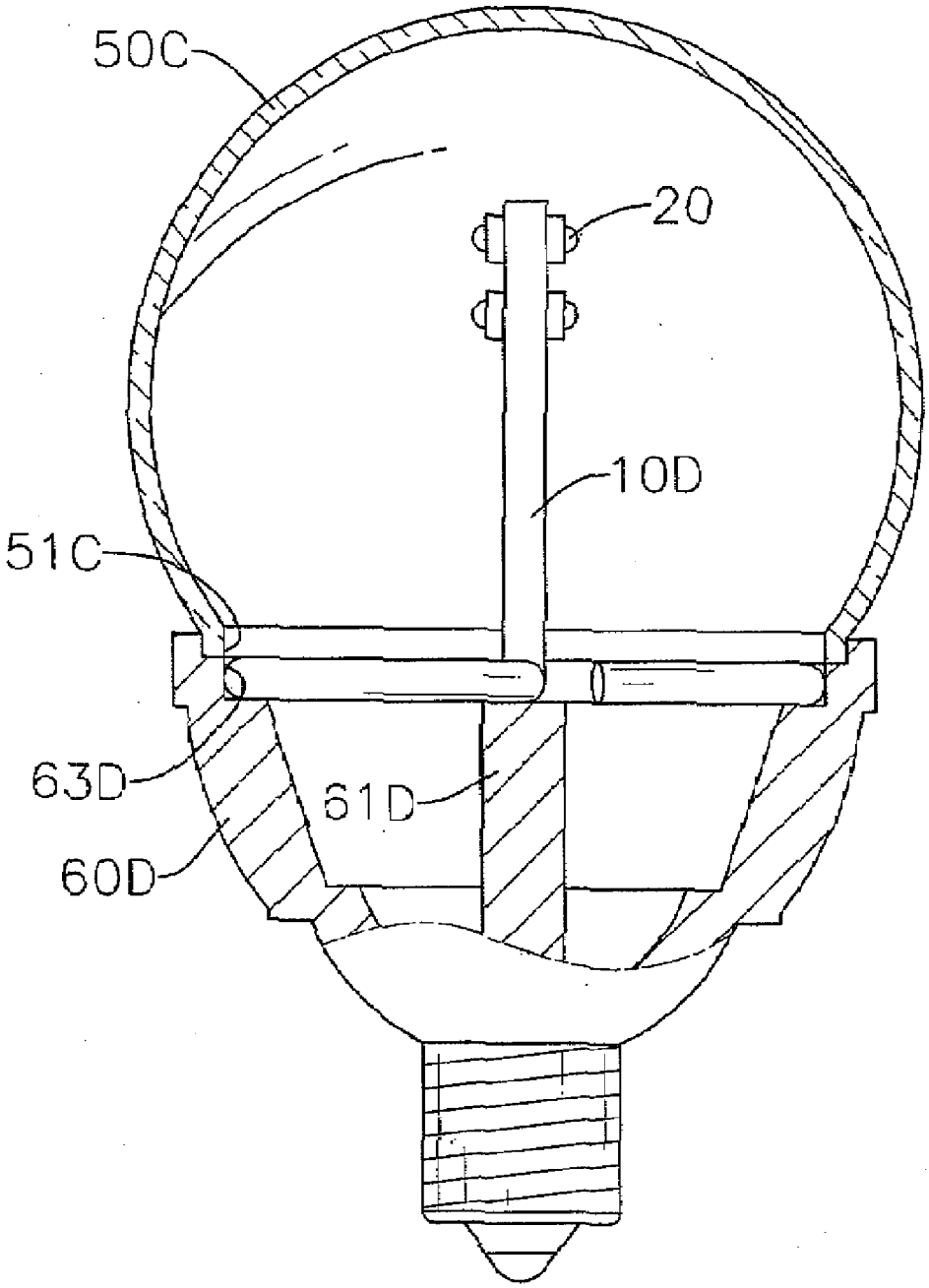
FIG. 11 is a side view in partial section of the LED lamp in FIG. 10.
Figure 12:
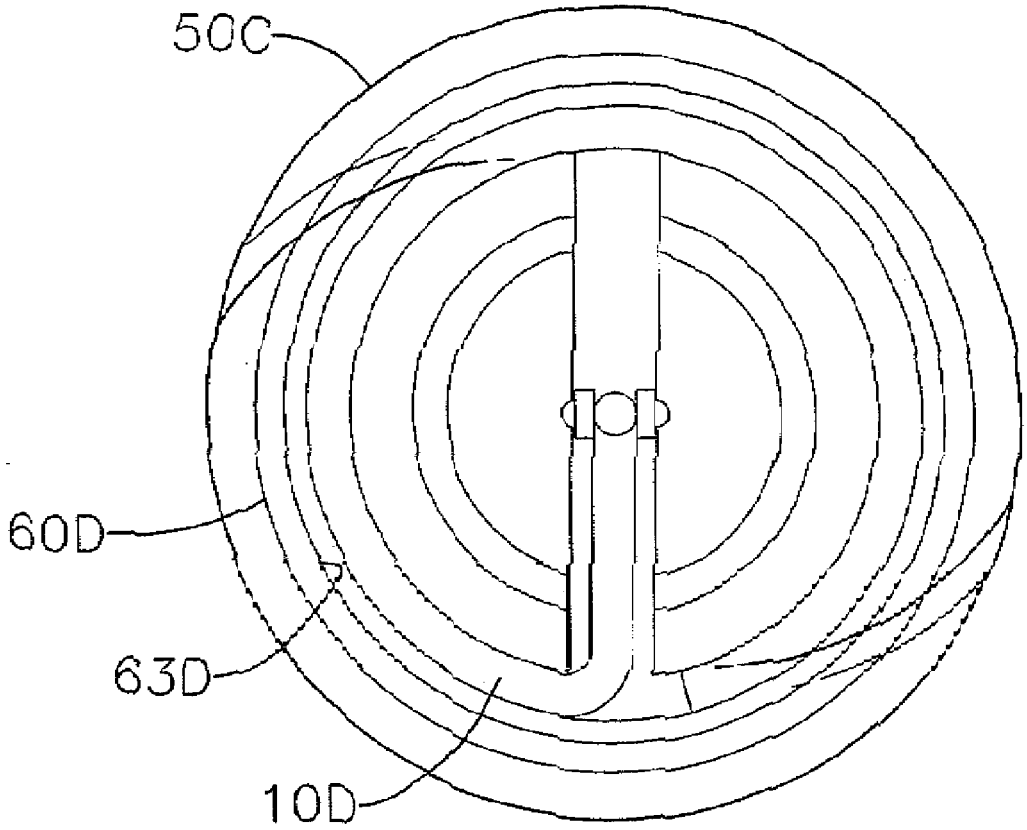
FIG. 12 is a top view of the LED lamp in FIG. 10.
Figure 13:
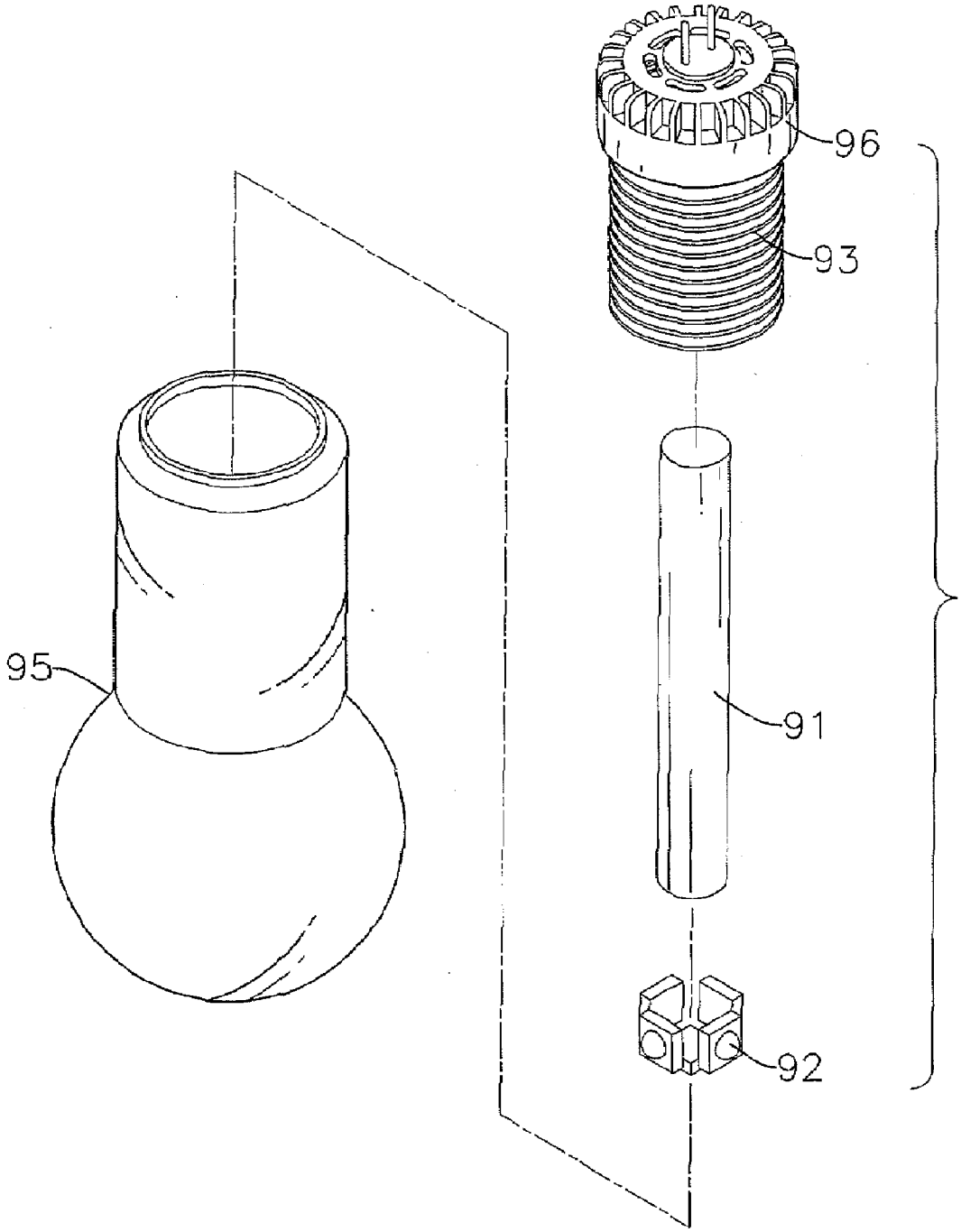
FIG. 13 PRIOR ART
FIG. 13 is an exploded perspective view of a conventional LED lamp in accordance with the prior art.
Figure 14:
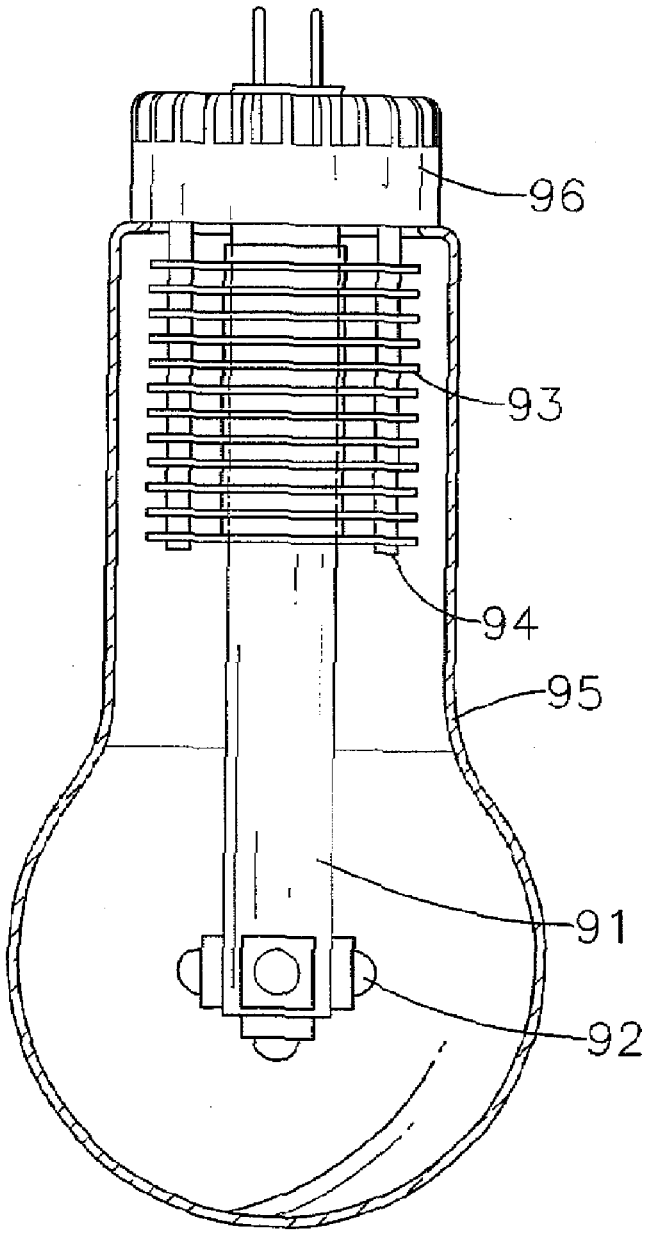
FIG. 14 PRIOR ART
FIG. 14 is a side view in partial section of the conventional LED lamp in FIG. 13.

With further reference to FIGS. 10 to 12, in the fifth embodiment, the outer surface of the tubular conductor (10D) near the distal end is attached the bridge (61D) of the base (60D). In addition, the distal end of the tubular conductor (10D) may be bent perpendicular from the bridge (61D) of the base (60D) for improved lighting.

With further reference to FIGS. 1 to 5, in the first, second or third embodiment, the multiple fins (30) are mounted on the outer surface of the tubular conductor (10, 10B) near the proximal end and may be annular.

The supporter (40) is attached to the proximal end of the tubular conductor (10), is mounted in the base (60) and comprises at least one optional positioning rod (42). The at least one positioning rod (42) is mounted through the rings (30) to hold and maintain ring positions.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An LED lamp comprising
- a base being metallic and comprising an electrical connector;
- a tubular conductor being filled with fluid and comprising an outer surface;
  - a proximal end being mounted on the base; and
  - a distal end;
- a bulb being pellucid, being connected to the base; and
- at least one LED being attached to the tubular conductor and electrically connected to the connector of the base; wherein
- the base is a metal housing and has
  - a mouth having an inner edge; and
  - a bridge having two ends being attached to the inner edge of the mouth of the base; and
- the tubular conductor thermally contacts the inner edge of the mouth of the base and the bridge; wherein
- the outer surface of the tubular conductor near the distal end and the outer surface of the tubular conductor near the proximal end thermally contact the bridge of the base.

2. The LED lamp as claimed in claim 1, wherein
- the outer surface of the tubular conductor near the distal end is primarily attached to the bridge of the base; and
- the tubular conductor is bent outwards from the bridge of the base allowing the distal end of the tubular conductor to be located within the bulb.

3. The LED lamp as claimed in claim 1, wherein
- the base has an inner surface and a bottom; and
- the bridge of the base extends and is attached to the inner surface and the bottom of the base.

4. The LED lamp as claimed in claim 3, wherein
- the connector of the base comprises a tip contact and a screw thread contact; and
- the tip contact and the screw thread contact of the connector are connected to the LED respectively.

5. The LED lamp as claimed in claim 3, wherein
- the connector of the base comprises two contact pins electrically connected to the LED respectively.

* * * * *